US010175032B2

(12) United States Patent
Cooper

(10) Patent No.: US 10,175,032 B2
(45) Date of Patent: Jan. 8, 2019

(54) WEARABLE PERSONAL PROTECTION DEVICE INCLUDING ADJUSTABLE ACTIVATION

(71) Applicant: Stephen Bradley Cooper, Houston, TX (US)

(72) Inventor: Stephen Bradley Cooper, Houston, TX (US)

(73) Assignee: Stephen Bradley Cooper, Houston, TX (US)

( * ) Notice: Subject to any disclaimer, the term of this patent is extended or adjusted under 35 U.S.C. 154(b) by 58 days.

(21) Appl. No.: 14/882,382

(22) Filed: Oct. 13, 2015

(65) Prior Publication Data

US 2016/0033238 A1 Feb. 4, 2016

Related U.S. Application Data

(63) Continuation-in-part of application No. 13/530,219, filed on Jun. 22, 2012, now Pat. No. 9,182,198.

(60) Provisional application No. 61/652,417, filed on May 29, 2012.

(51) Int. Cl.

| | |
|---|---|
| ***F41H 9/10*** | (2006.01) |
| ***A41D 19/00*** | (2006.01) |
| *A41D 19/015* | (2006.01) |
| *A41D 13/08* | (2006.01) |

(52) U.S. Cl.

CPC ..... *F41H 9/10* (2013.01); *A41D 19/0031* (2013.01); *A41D 13/087* (2013.01); *A41D 19/0024* (2013.01); *A41D 19/01594* (2013.01)

(58) Field of Classification Search

CPC . F41H 9/10; A41D 19/0024; A41D 19/01594; A41D 13/087; A41D 19/0031

USPC ..... 239/529

See application file for complete search history.

(56) References Cited

U.S. PATENT DOCUMENTS

| | | | | |
|---|---|---|---|---|
| 4,315,238 A * | 2/1982 | Eventoff | ..... | B60C 23/0408 338/100 |
| 5,673,436 A * | 10/1997 | Piper | ..... | F41H 9/10 2/160 |
| 2013/0320104 A1* | 12/2013 | Cooper | ..... | F41H 9/10 239/1 |

* cited by examiner

*Primary Examiner* — Jason Boeckmann

(74) *Attorney, Agent, or Firm* — Conley Rose, P.C.

(57) ABSTRACT

A personal protection apparatus includes a wearable covering, a reservoir supported on the wearable covering and containing a sprayable fluid and includes a valve operable to control the flow of fluid from the reservoir. The apparatus further includes a circuit having a force-sensing resistor for actuating the valve. The force-sensing resistor is disposed on a thumb covering and is activated under pressure when the wearer's thumb is positioned between the index finger and middle finger. Pressure on the force-sensing resistor decreased its resistance in the circuit. With the resistance lowered, current is allowed to flow and a power supply powers a servomotor coupled to a cam that opens a valve to allow fluid to be sprayed.

18 Claims, 10 Drawing Sheets

WEARABLE PERSONAL PROTECTION DEVICE INCLUDING ADJUSTABLE ACTIVATION

CROSS-REFERENCE TO RELATED APPLICATIONS

This application is a continuation in part of U.S. application Ser. No. 13/530,219 filed Jun. 22, 2012, which claims the benefit under 35 U.S.C. § 119(e) of U.S. Provisional Patent Application No. 61/652,417 filed May 29, 2012, the disclosure of each being incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

FIELD OF THE DISCLOSURE

This disclosure generally relates to personal protection devices that can be worn by the user of the device.

BACKGROUND OF THE DISCLOSURE

Being attacked or assaulted is often a function of an assailant surprising their potential victim when the victim is unarmed or unprepared (even if the victim is in possession of a non-lethal self-defense device, e.g. pepper spray, or is armed with a weapon). The threat of accidental discharge of a weapon, or the hindrance caused by having to have a weapon or other self-defense device in-hand and at the ready, may lead to the device not being carried routinely in circumstances where the user could be vulnerable (e.g. any poorly lit and/or sparsely populated area including some parking lots, public streets or parks, or parking garages and subways).

Known personal defense devices (Piper, U.S. Pat. No. 5,673,436 and Torrence, U.S. Pat. No. 6,966,462) have been designed to employ a single mechanical actuator or electronic button that is activated in order to spray the irritant. However, this single button or mechanism was positioned in an area where the wearer could either routinely touch the button with normal motion of the hand, or the button was on the outside of the hand where it could accidentally come in contact with other objects. Thus, the button was highly vulnerable to being accidentally depressed if the wearer of the device tried to wear it and carry on normal activities and hand motions (e.g. put the hand wearing the device into a pocket or purse or simply brush the hand wearing the device against a solid object). A primary disadvantage of such prior devices is the unintentional spraying of repellant.

There remains a need for a device that can be worn on the hand that is immediately available to discharge a repellant such as irritants (e.g. tear gas) or inflammatory agents (e.g. pepper spray), but that is less likely to be accidentally discharged or to hinder the normal use of the hand upon which the device is worn.

SUMMARY OF THE PRESENT DISCLOSURE

The embodiments described herein are generally directed to a personal protection apparatus comprising a glove, a reservoir supported on the glove, a fluid delivery tube in fluid communication with the reservoir, a valve electrically operable to open and close and thereby control the flow of fluid from the reservoir into the delivery tube; a power supply supported on the glove; and a switch supported on the glove for electrically coupling the valve and the power supply.

In an embodiment, a personal protection apparatus for a wearer comprises a glove comprising an index finger covering and a thumb covering, the index finger covering including a first switch contact and the thumb covering including a second switch contact. The first and second switch contacts are positioned on the glove so as to come into engagement with one another when the wearer's thumb is positioned between the wearer's index finger and middle finger. The personal protection apparatus further comprises a reservoir supported on the glove and adapted for containing a fluid repellant, and a fluid delivery tube in fluid communication with the reservoir, wherein at least a portion of the tube is supported by the thumb covering. The personal protection apparatus additionally comprises an electrically actuatable valve configured to control the flow of repellant from the reservoir and through the tube and a power supply supported by the glove and electrically coupled to the valve so as to actuate the valve when the first and second contacts are engaged.

The embodiments described herein are also generally directed to a method for actuating a switch, comprising placing a glove on the hand of a person, placing a thumb covering of the glove between an index finger covering and a middle finger covering of the glove, and connecting conductive electrical contacts on the bottom inside edge of the index finger covering with the top of the thumb covering between the knuckle and the thumb nail. Moreover, the glove comprises a reservoir configured to contain a fluid, a flexible tube, and a first and second electrical contact coupled to a power source and a valve.

Thus, embodiments described herein comprise a combination of features and characteristics intended to address various shortcomings associated with certain prior methods. The various features and characteristics described above, as well as others, will be readily apparent to those skilled in the art upon reading the following detailed description of the exemplary embodiments, and by referring to the accompanying drawings. It should be appreciated by those skilled in the art that the conception and the specific embodiments disclosed may be readily utilized as a basis for modifying or designing other structures for carrying out the same purposes of the embodiments described herein. It should also be realized by those skilled in the art that such equivalent constructions do not depart from the spirit and scope of the invention as set forth in the appended claims.

BRIEF DESCRIPTION OF THE DRAWINGS

For a detailed description of exemplary embodiments of the disclosure, reference will now be made to the accompanying drawings in which.

NOTATION AND NOMENCLATURE

Figure 1:
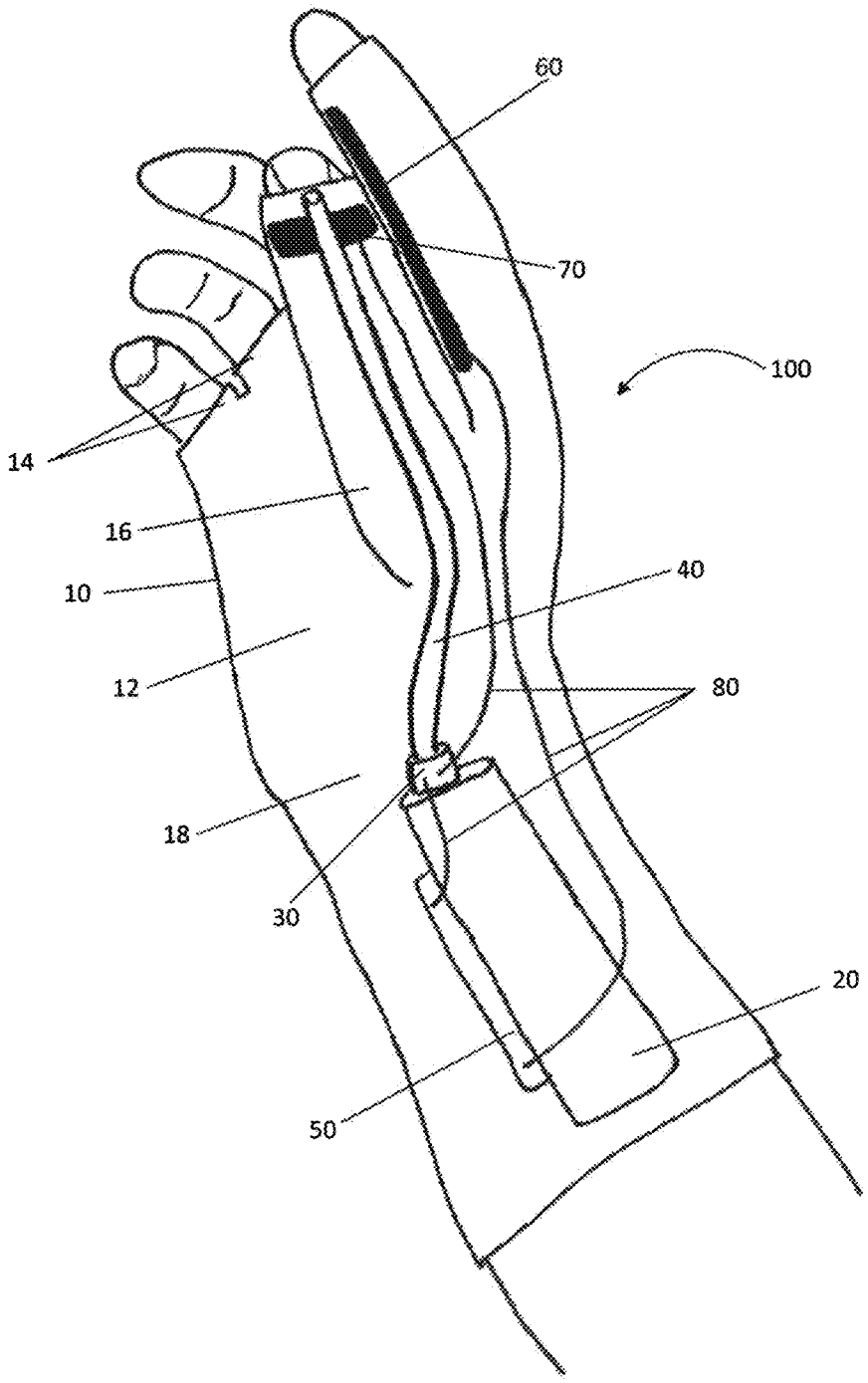
FIG. 1 is a perspective view of a right-handed embodiment of a personal protection device installed on a hand and made in accordance with principles described herein.

The drawing figures are not necessarily to scale. Certain features of the disclosed embodiments may be shown exaggerated in scale or in somewhat schematic form, and some details of conventional elements may not be shown in the interest of clarity and conciseness.

In the following discussion and in the claims, the term "including" and "comprising," as well as derivations of these terms, are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct engagement of the two, or may be through an indirect connection via other intermediate devices, components, and connections. The term "based on" means "based at least in part on." Therefore, if X is based on Y, X may be based on Y and any number of other factors.

DETAILED DESCRIPTION OF THE DISCLOSED EXEMPLARY EMBODIMENTS

The wearable personal protection device disclosed herein employs a hand configuration safety mechanism that is intended to address certain shortcomings associated with previous personal defense devices. The wearable personal protection device allows the wearer, i.e. the user, to have instant access to a self-defense device while preventing unintended discharges and allowing the wearer to safely maintain normal use of his/her hand when it is not necessary to activate and use the device. In some embodiments, the wearable personal protection device may be aimed in a similar manner as a handgun in order to direct a spray of fluid against a would-be assailant. In various embodiments, the wearable personal protection device may provide non-lethal protection for the wearer.

Referring to FIG. 1, an example of a personal protection device (PPD) 100 installed on a right hand is shown. The personal protection device 100 may also be configured for and installed on a left hand. In an embodiment, the personal protection device 100 comprises a glove 10, a small reservoir 20, an electrically operated valve 30, a fluid delivery tube 40, a power supply 50, electrically conductive material 60, 70, and electrical conductors 80.

Referring still to FIG. 1, glove 10 generally includes a palm covering 12 that covers the wearer's palm, finger coverings 14, including a thumb covering 16, and a wrist covering 18, each such covering, individually and in combination with others, may also be referred to herein as a wearable covering. In the embodiment shown, the finger coverings 14 extend from the palm covering 12, but do not extend to and enclose the wearer's fingertips and, thus, do not cover the entire finger. Instead, to provide the wearer dexterity and tactile feedback, the finger coverings 14, including the thumb covering 16, leave the fingertips exposed in this embodiment. As best shown in FIG. 1, in this embodiment, the thumb covering 16 extends substantially to the proximal edge of the wearer's thumbnail.

The wrist covering 18 extends from the palm covering 12 and, in the embodiment shown in FIG. 1, extends a distance past the wearer's wrist and up the wearer's arm. This provides a convenient location to support other components of the system, described below.

As used herein, the term glove is meant to include a complete glove or a partial glove. A partial glove is one that at least partially covers the wearer's palm and includes at least a thumb covering and an index finger covering, where the thumb covering and index finger covering may extend and cover the fingertip of the wearer. In the embodiment shown in FIG. 1, all the finger coverings 14 of glove 10 are open at their ends, leaving all fingertips exposed.

Glove 10 shown in FIG. 1 is constructed from a single material that is compliant and that may be a natural material, such as leather or wool, or a man-made fabric or other material such as polyester or acrylic. In the embodiment shown in FIG. 1, the entire glove 10 is made from the same material; however, in other embodiments, the palm covering 12 may be made of a first material, with other portions, such as the finger coverings 14, as example, may be made of a second, different material.

In an embodiment, the small reservoir 20 comprises a form-fitting exterior shape, which is contoured to fit the human wrist and/or forearm or soft-sided to reduce the physical presence of the reservoir 20. Reservoir 20 may be made of plastic, metal, or any suitable material and is sized to contain several ounces of pressurized liquid or gas. In an embodiment, the reservoir 20 is attached to a portion of the material of the glove 10 that extends past the wrist. The reservoir 20 may be mounted on the material that covers the inside of the arm on which the glove 10 is worn. For example, elastic straps or hook-and-loop fasteners may be used to retain the reservoir 20 on the glove 10. Such fastening means permit the reservoir 20 to be removed for refilling or replaced with additional disposable reservoirs 20. The pressurized fluid may be a repellant, which may include pepper spray or other inflammatory agent, or tear gas or other irritant, for example. In another embodiment, the reservoir 20 may contain water or another liquid, allowing the device 100 to be used as a squirt toy.

Still referring to FIG. 1, an electrically operated valve 30 is disposed at an opening at the top of the reservoir 20 and is coupled to, and in fluid communication with, a fluid delivery tube 40. The valve 30 may be made of metal or any suitable material. Valve 30 is in fluid communication with the reservoir 20 and the fluid delivery tube 40.

In the embodiment shown in FIG. 1, the fluid delivery tube 40 is supported by and attached to the glove 10 and extends from the valve 30 over the side of the wrist, down the length of the thumb, and terminates on the top side of the thumb covering 16 of the glove 10. The fluid delivery tube 40 is flexible and made of plastic, rubber, or any suitable material. In the embodiment of FIG. 1, the tube 40 terminates at or within about 10 mm of the wearer's thumb nail.

Referring again to FIG. 1, a power supply 50 is disposed on the glove 10. The power supply 50 is shown in FIG. 1 disposed adjacent to the reservoir 20; however, the power supply 50 can be configured in different shapes and disposed in various locations on the glove 10. The power supply 50 may be a battery or other device used to store energy. Further, the power supply 50 may be attached in such a way that it is removable and replaceable. Elastic straps or hook-and-loop fasteners are examples of means to retain the power supply 50 on the glove 10.

Still referring to FIG. 1, the personal safety device 100 further comprises electrically conductive material 60, 70, forming electrical contacts of a switch 65 (discussed in greater detail below). The interior edge closest to the middle finger on the underside material of the index finger covering includes a strip 60 of an electrically conductive substance that is permanently adhered to the material of the glove 10. The top of the material on the thumb of the glove 10 between the thumb knuckle and thumb nail includes a strip 70 of an electrically conductive substance permanently adhered to the material of the glove 10. The conductive metallic substance of strips 60, 70 may be copper, silver, tape, or a type of metallic fabric, for example.

Figure 2:
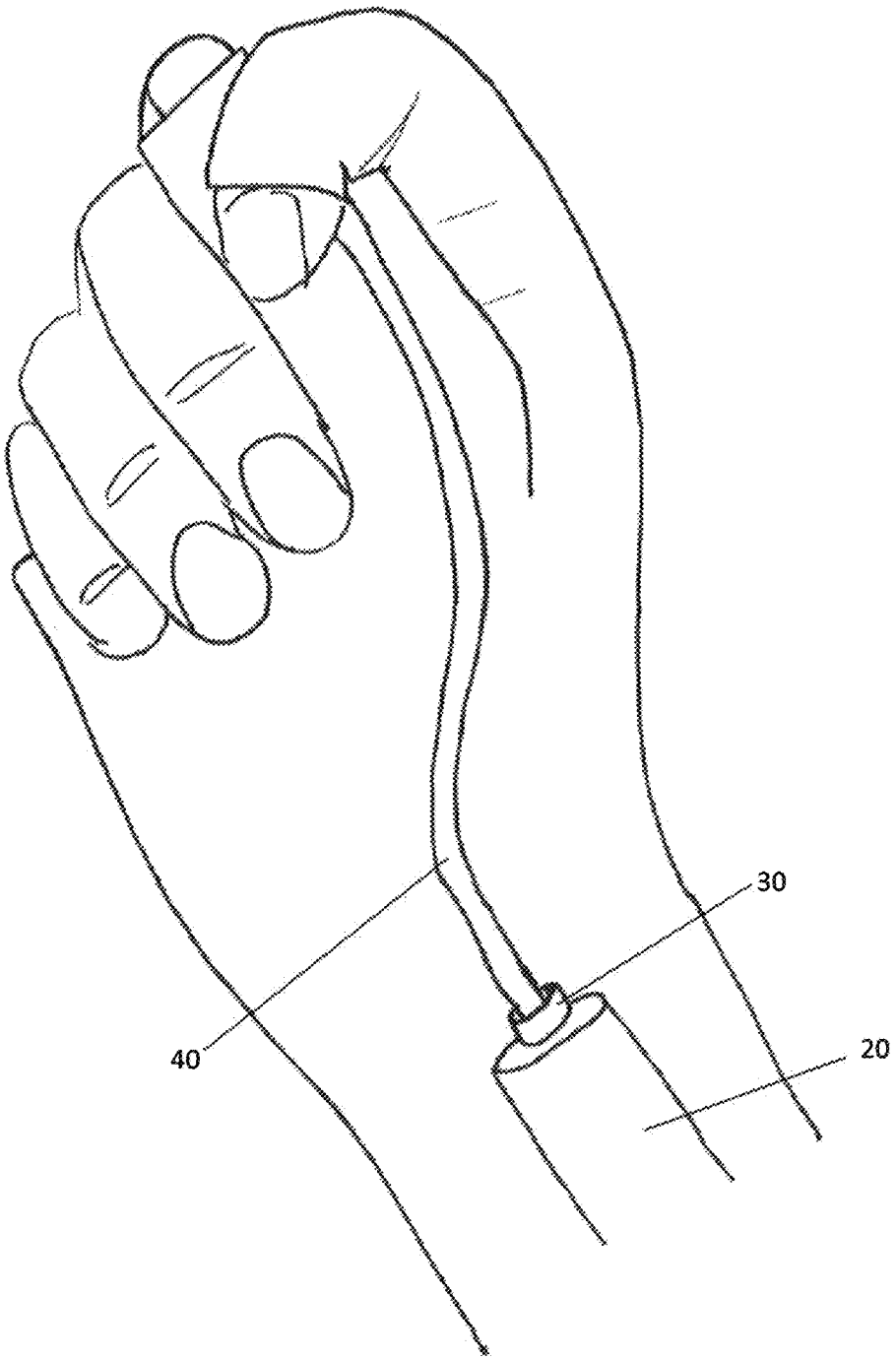
FIG. 2 is a perspective view of an embodiment of the device installed on a hand as the wearer makes the gesture that opens the valve to spray the pressurized liquid.

Referring now to FIG. 2, the conductive strip 60 on the index finger is aligned on the inside, lower edge of the index finger in such a way as to allow it to come in contact with the conductive strip 70 on the top of the thumb between the knuckle and the thumb nail if the wearer of the glove 10 were to place his/her thumb between the index and middle fingers while curling the fingers into a fist.

Referring again to FIG. 1, the personal safety device 100 further comprises electrical conductors 80, which are supported by and attached to the glove 10. The electrical conductors 80 couple the two electrically conductive strips 60, 70 to the valve 30 and the power supply 50, and couple the valve 30 to the power supply 50. The electrical conductors 80 and the components in electrical connection with (i.e. coupled to) the conductors 80 form an electrical circuit 85 shown in FIG. 3.

Figure 3:
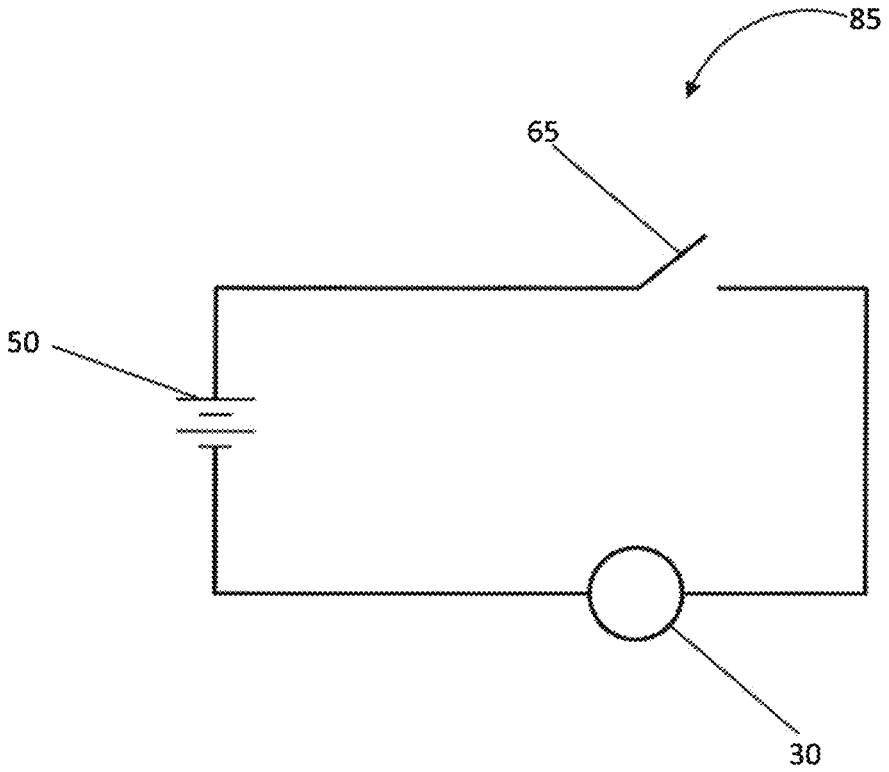
FIG. 3 is a schematic circuit diagram of a portion of the embodiment shown in FIG. 1.

Referring now to FIG. 3, the electrical circuit 85 comprises a switch 65, electrically operated valve 30, and power source 50 (shown in FIG. 3 as a battery 50). The switch 65 comprises the two conductive strips 60, 70 on the index finger and thumb—the conductive strip 60 on the index finger or first switch contact and the conductive strip 70 on the thumb or second switch contact. In the unactuated state, where the two conductive strips 60, 70 are not in contact with each other, the switch 65, and thus the circuit 85, is open as illustrated schematically in FIG. 3. When the two conductive strips 60, 70 come in contact with each other, the switch 65, and thus the circuit 85, is closed, which causes the electrically operated valve 30 to open and release the pressurized fluid contained in the reservoir 20.

The personal protection device 100 can be actuated, when desired by the wearer of the glove, by placing the thumb on the side of the middle finger and then placing the index finger on top of the thumb. The wearer, if desired, can also actuate the personal protection device 100 by closing the middle, ring, and small fingers into a fist, placing the surface of the thumb on the second knuckle of the middle finger, and then placing the index finger across the top of the thumb nail (forming the children's playful "got your nose" fist-like configuration shown in FIG. 2). These particular hand configurations required to actuate the personal safety device 100 reduce the possibility of accidental actuation and discharge of fluid from the device 100.

The conductive strip 60 on the index finger is then in contact with the conductive strip 70 on the top of the thumb. When the two conductive strips 60, 70 are in contact with each other, the low-voltage electrical circuit 85 is closed, which then powers the valve 30 to open and release the pressurized fluid (liquid or gas) that is contained inside the reservoir 20.

The pressurized fluid is then released from the discharge end of the fluid delivery tube 40 located at the end of the wearer's thumb. The wearer of the personal protection device 100 can aim the sprayed fluid by simply pointing his/her thumb, while in the proper hand configuration, at the desired target.

The wearer can stop the release of the pressurized liquid by lifting his/her index finger from the top of the thumb, thereby breaking the contact between the conductive strips 60, 70 This action opens the low-voltage electrical circuit 85, and, in turn, removes power from the valve 30 and ceases the release of the fluid. The wearer of the device 100 may continue to release all the fluid from the reservoir 20 by continuing to hold the index finger on top of the thumb, thereby keeping the low-voltage electrical circuit 85 closed. As previously discussed, in some embodiments, the reservoir 20 is removable and replaceable. Once all the fluid is dispelled from the reservoir 20, the reservoir may be removed and refilled or replaced with a new reservoir 20 pre-filled with the desired fluid.

Figure 4:
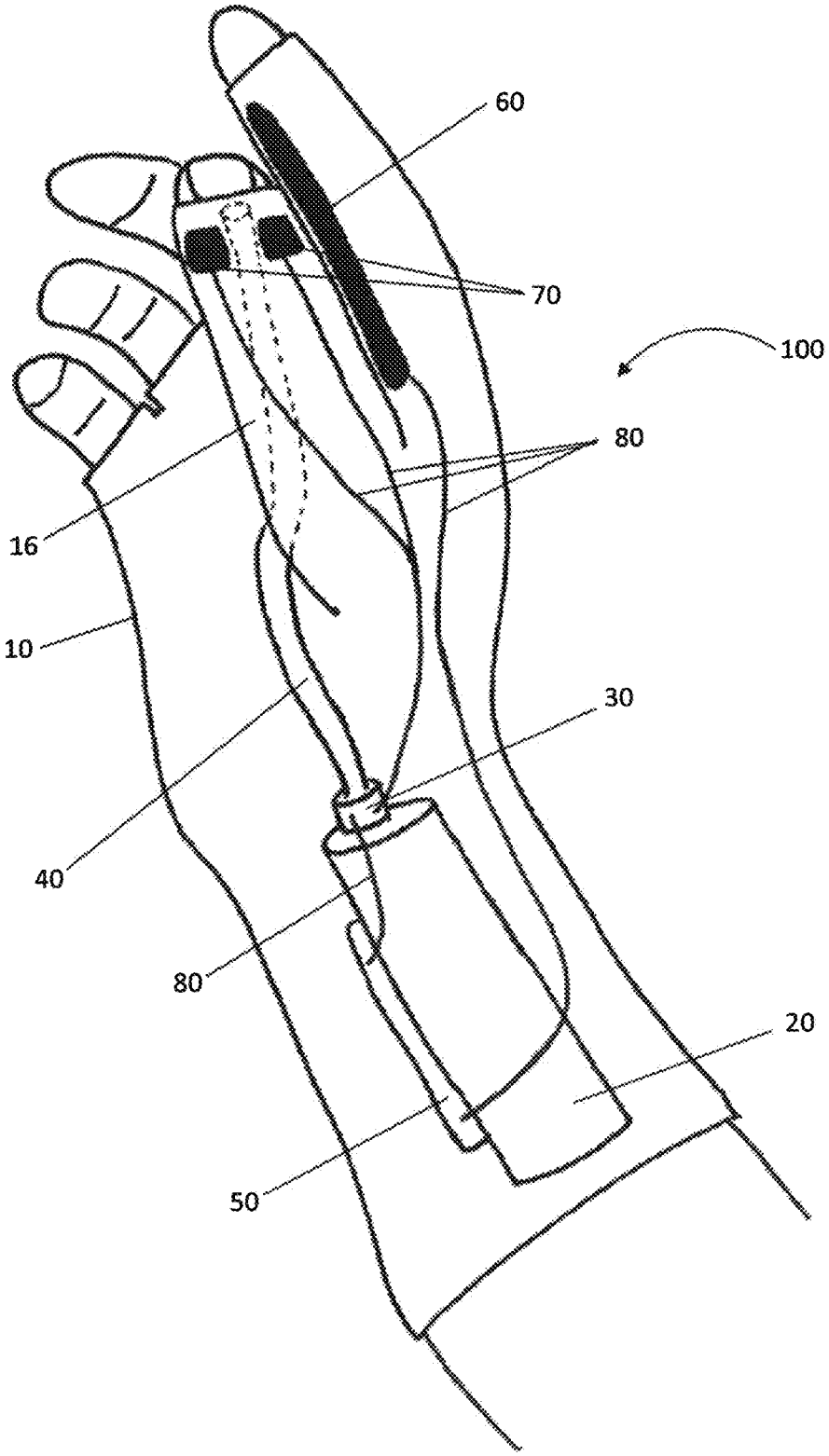
FIG. 4 is a perspective view of another right-handed embodiment of a personal protection device installed on a hand and made in accordance with principles described herein.

Referring now to FIG. 4, in this embodiment, the fluid delivery tube 40 extends from the valve 30 along the palm and terminates on the underside of the thumb covering 16 of the glove 10. In this embodiment, the strip 70 of electrically conductive substance on the thumb portion of the glove 10 comprises two strips—one on the right top side of the thumb between the knuckle and thumb nail, and the other on the left top side of the thumb between the knuckle and thumb nail. Though the underside fluid delivery tube 40 is shown in FIG. 4 with the two-piece thumb strip 70 on the top of the thumb portion of the glove 10, the underside fluid delivery tube 40 may also be used with the one-piece strip 70 shown in FIG. 1. Furthermore, the two-piece thumb strip 70 shown in FIG. 4 may be used with the fluid delivery tube 40 disposed on the top side of the thumb as shown in FIG. 1.

Figure 5:
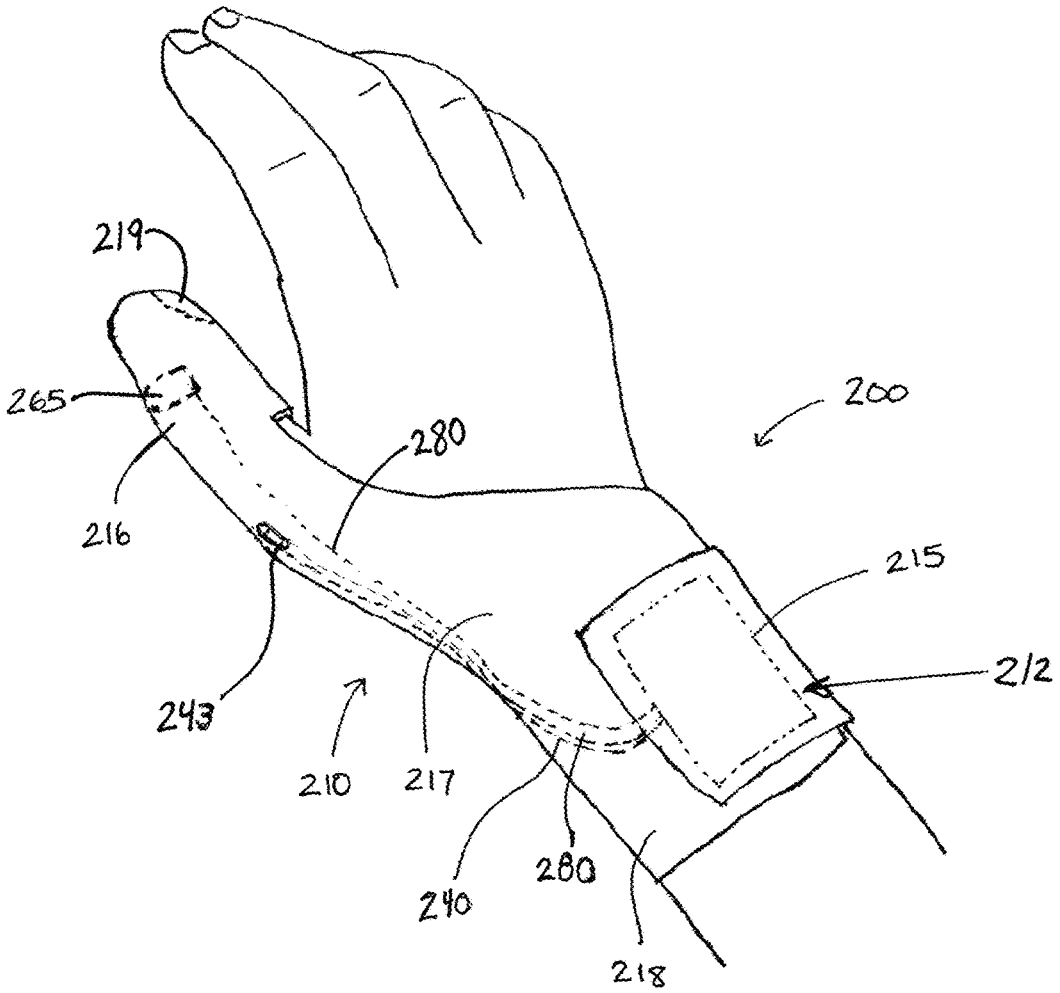
FIG. 5 is a perspective view of another right-handed embodiment of a personal protection device installed on a hand and made in accordance with principles described herein.

Referring to FIG. 5, another example of a personal protection device (PPD). As shown, PPD 200 is installed on the right hand of a wearer. The personal protection device 200 may also be configured for and installed on a left hand. The personal protection device 200 comprises a wearable covering 210, a fluid delivery system 212, and an enclosure or housing 215 that contains some components of fluid delivery system 212. The fluid delivery system 212 and the housing 215 are attached to or held within portions of wrist covering 210.

Wearable covering 210 includes a thumb covering 216, a connecting or bridging portion 217, and a wrist strap 218. When worn on the body, the thumb covering 216 generally surrounds the tip of the wearer's thumb, the wearer's thumb nail, and a portion of the wearer's thumb extending from the thumb nail toward the second knuckle. In some embodiments, the thumb covering 216 extends beyond the second knuckle toward the first knuckle at the base of the thumb.

The thumb covering extends from the tip of the wearer's thumb to the connecting portion 217. The connecting portion 217 extends from the thumb covering 216 to the wrist strap 218 and wraps around a portion of the wearer's palm and wrist. The wrist strap 218 wraps around and covers a portion of the wearer's wrist and forearm. The wrist strap 218 supports housing 215 and other components of the system, described below.

The wearable covering 210 is constructed from a single material that is compliant and may be a natural material, such as leather or wool, a man-made fabric, such as polyester, nylon, or acrylic, or other material and may have elastic properties. In the embodiment shown in FIG. 5, the entire wearable covering 210 is made from the same material; however, in other embodiments, the thumb covering 216 may be made of a first material, with other portions, such as the wrist strap 218, for example, made of a second, different material. The wrist strap 218 in the present embodiment wraps around a portion of the wearer's wrist and arm and is releasably secured on the wearer with a fastener. Any fastener known in the art including, but not limited to, hook and loop fasteners, snaps, and clasps similar to those used in watch bands may be used. Further, in some embodiments, the wrist strap 218 may be one continuous loop of elastic material configured and sized to fit around the wearer's wrist and arm.

The front side of the thumb covering 216 includes a contact region 219 located where the wear's thumb or thumbprint (fingerprint) may press against an object or a surface, such as the surface of a touch screen telephone, a grocery self-check-out point-of-sale, or another electronic device. As shown, the contact region 219 comprises the same material as the remainder of thumb covering 216 and may be indistinguishable from the remainder of covering 216. In various embodiments, the material and shape of contact region 219 may be selected in to enhance the tactile feel and dexterity of the wear's thumb as compared to a traditional glove or to aid a wearer to interact more effectively with a touch-screen user-interface panel. For example, in some embodiments, contact region 219 comprises a material that is different than the remainder of thumb covering 216 and is designed for interacting with a touch-screen display panel. The material may provide a capacitive coupling between the wearer and touch screen. The material may include electrically conductive features. In some embodiments, contact region 219 is an aperture, lacking any material. Contact region 219 may be oval, rectangular, or may comprise another shape.

Figure 6:
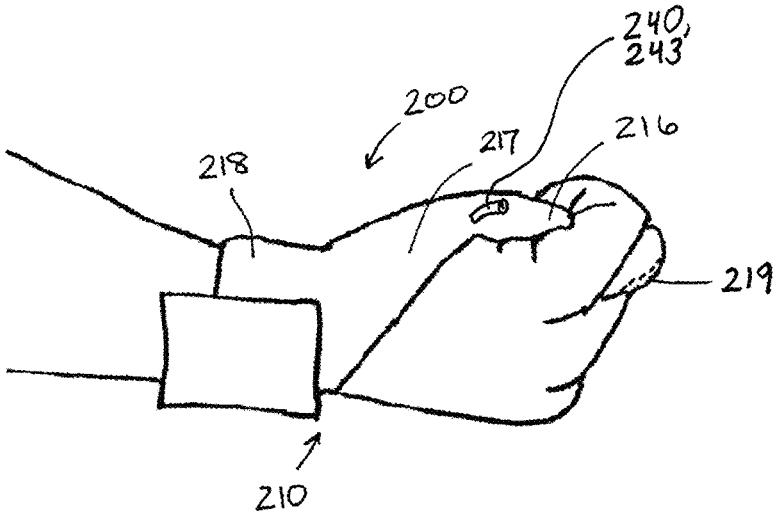
FIG. 6 is a perspective view of the embodiment shown in FIG. 5 installed on a hand while the wearer makes the gesture that triggers the release of pressurized fluid.

FIG. 6 shows a wearer, i.e. a user, activating the personal protection device 200 by forming the "got your nose" fist-like configuration, as may be done to spray a liquid or to test the device without spraying a liquid.

Figure 7:
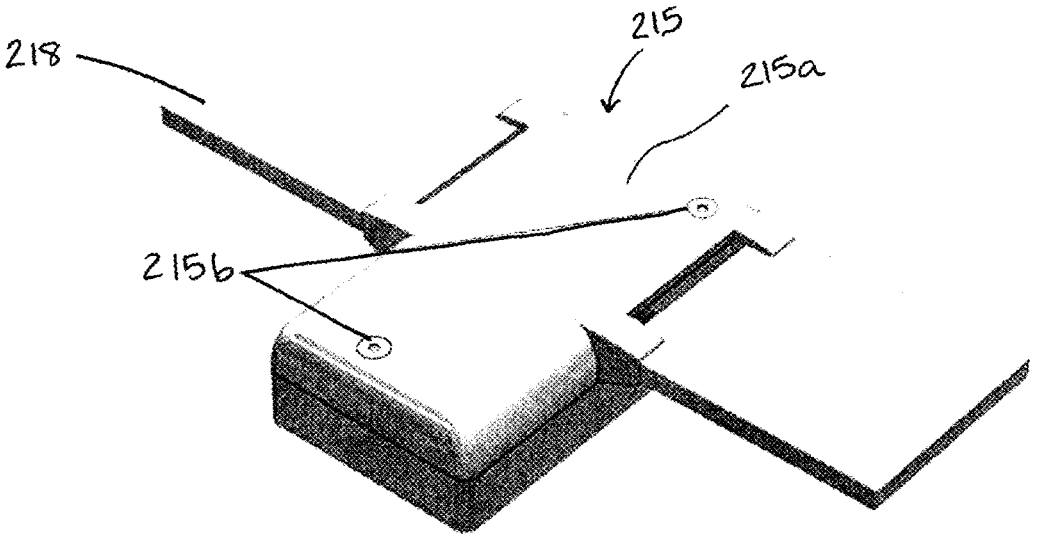
FIG. 7 is a bottom perspective view of a portion of the embodiment shown in FIG. 5.
Figure 8:
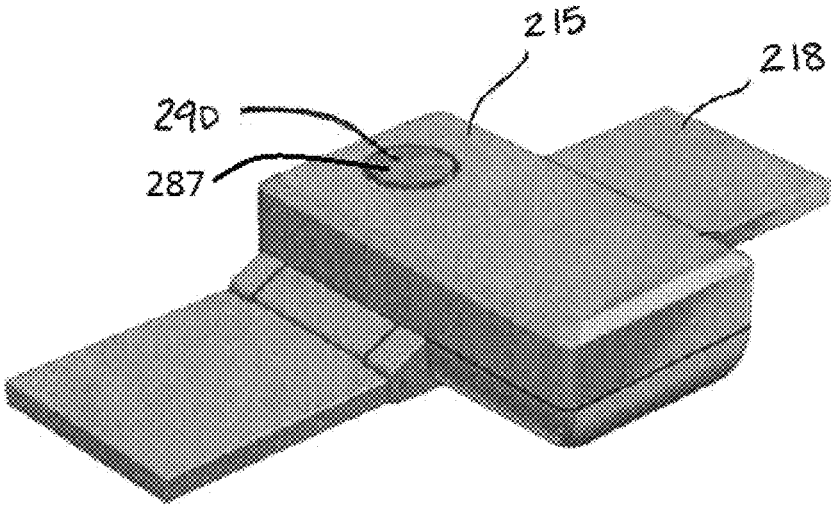
FIG. 8 is a top perspective view of a portion of the embodiment shown in FIG. 5.

Referring now to FIG. 7, in the present embodiment, the housing 215 is generally box-like having at least one removable panel 215*a* to allow access to components disposed therein. The removable panel 215*a* may be secured to housing 215 with fasteners, such as screws, straps, or snaps, or may slidingly engage a channel in the housing 215 within a corresponding groove. In the present embodiment, panel 215*a* is secured to housing 215 with screws 215*b*. The housing 215 is coupled to the wrist strap 218 with any suitable fastener(s) known in the art including, but not limited to, elastic straps, hook-and-loop fasteners, adhesives, watch-band pins, and thread or stitching. In other embodiments, the housing may be coupled to the connecting portion 217 and the wrist strap 218. FIG. 8 shows another view of housing 215 coupled to wrist strap 218 and containing a push-button switch 287 and a light-emitting diode (LED) 290. Switch 287 is accessible and actuatable from the exterior of the housing 215, and LED 290 is visible from the exterior of the housing 215. In this embodiment, switch 287 and LED 290 are a single unit, and switch 287 includes a normally-open, non-latching push-button. In some situations, pressing switch 287 activates LED 290 embedded within or behind a translucent cover on switch 287. FIG. 8 may represent the top view of housing 215, i.e. having the side that faces away from the main body of wearable covering 210 so that LED 290 is visible to the wearer of personal protection device 200 or to other people. However, as in FIG. 5 and FIG. 6, wearable covering 210 may include a flap or a pocket within which the housing 215, the switch 287, and the LED 290 combination may be held, away from view of passers-by.

Figure 9:
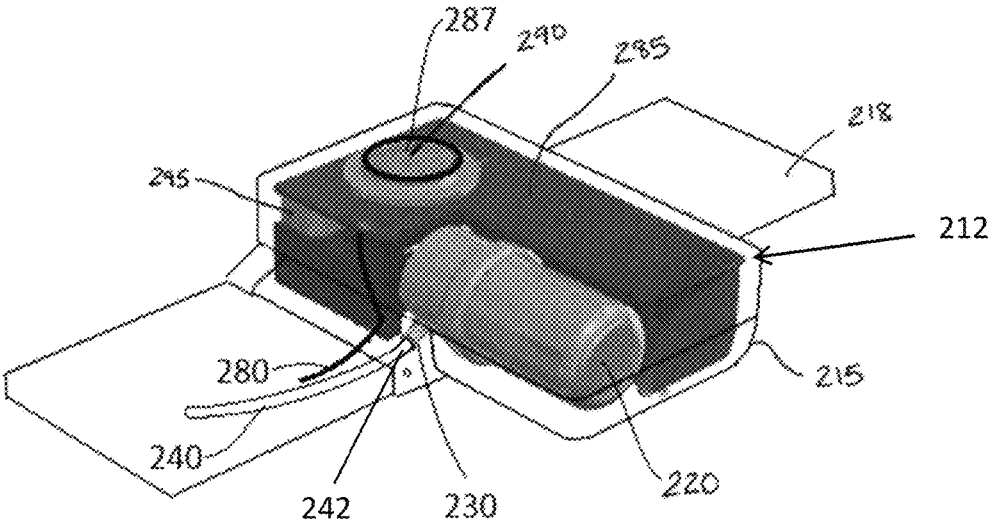
FIG. 9 is a cutaway perspective view of a portion of the embodiment shown in FIG. 5.
Figure 10:
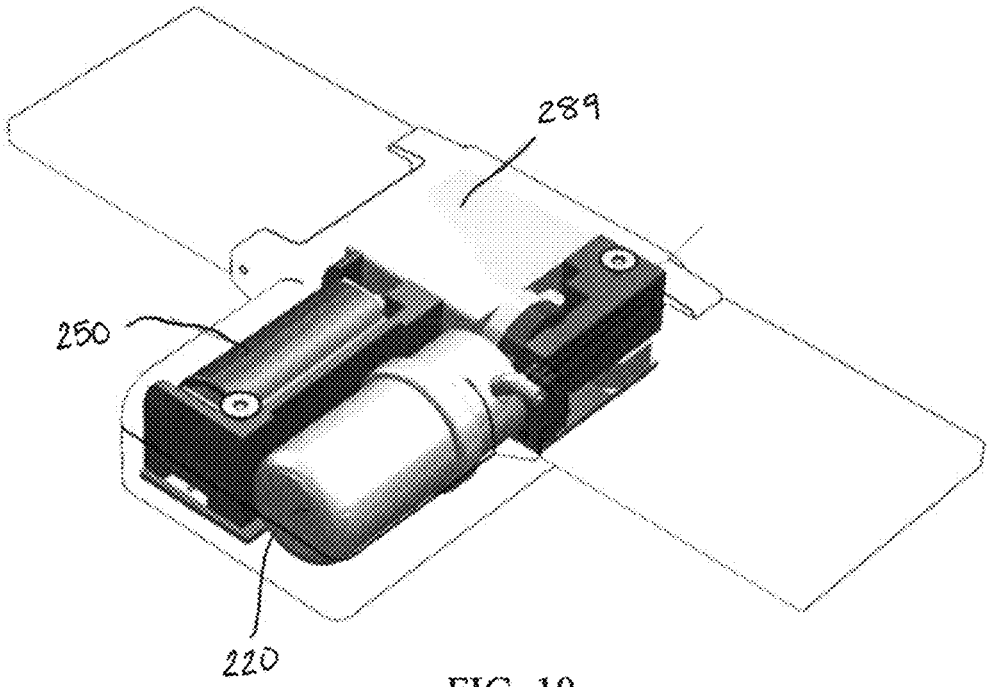
FIG. 10 is a cutaway perspective view of a portion of the embodiment shown in FIG. 5.

Referring now to FIG. 9 and FIG. 10, the housing 215 is configured and sized to enclose various components of the fluid delivery system 212. In an embodiment, the housing 215 encloses a reservoir 220 aligned along a reservoir axis 221, a valve 230, a portion of a tubing 240, a power source 250, a circuit board 285 with a processor 286, an actuator 289, the switch 287, the light-emitting diode (LED) 290, and a speaker or 295. Tubing 240 will also be called a fluid delivery tube. The buzzer 295 may be replaced by any suitable sound emitting device. The reservoir 220 may be made of plastic, metal, or any suitable material and is sized to contain several ounces of pressurized liquid or gas. In the present embodiment, the reservoir 220 includes a cylindrical canister that is removable from the housing 215 for refilling or replacement, and the reservoir axis 221 generally corresponds to the central axis of the cylinder. In an alternative embodiment, the reservoir may be 220 attached to a portion of the wearable covering 210. For example, elastic straps or hook-and-loop fasteners may be used to retain the reservoir 220 on the wearable covering 210 to allow the reservoir 220 to be removed for refilling or replaced with additional disposable reservoirs 220. The pressurized fluid may be a repellant, which may include pepper spray or other inflammatory agent, or tear gas or other irritant, for example. In another embodiment, the reservoir 220 may contain water or another liquid that allows the personal protection device 200 to be used as a squirt toy.

Still referring to FIG. 9 and FIG. 10, the valve 230 is fluidically coupled between the reservoir 220 and the fluid delivery tube 240. Valve 230 controls fluid flow from the reservoir 220 through the tube 240. The valve 230 may be made of metal, plastic, or any suitable material or combination of materials. In the present embodiment, reservoir 220 and valve 230 are a single unit or assembly, for example, a pre-packaged, pressurized canister of pepper spray. Valve 230 may be a normally closed valve held by a resilient member, such as spring, that assists the valve to close.

Referring now to FIG. 5, FIG. 9, and FIG. 10, the fluid delivery tube 240 is supported by and attached to the wearable covering 210. Tube 240 includes an inlet end 242 coupled to valve 230 within housing 210 and extends from the valve 230, exits the housing 215, and extends across the wrist strap 218, along the connecting portion 217, and along the thumb covering 216. Tube 240 may be positioned underneath, within, or on top of various portions of wearable covering 210. Tube 240 terminates at a tubing discharge end 243 positioned on the outside of the connecting portion 217 of wearable covering 210 proximate the intended location of the first knuckle of the wearer's thumb. The discharge end 243 tube 240 is open to the atmosphere and is configured to point over the index finger when the wearer makes the gesture that triggers the release of pressurized fluid as shown in FIG. 6. The fluid delivery tube 240 is flexible and made of plastic, rubber, or any suitable material. In the embodiment of FIG. 5, the tube 240 is partially imbedded within the various components of wearable covering 210 and is routed generally along the top side of the wear's thumb (i.e. the side that includes the wearer's thumb nail). In other embodiments, tubing discharge end 243 may positioned at another location on the thumb or another part of the hand. Referring again to FIG. 10, the power source 250 is disposed adjacent the reservoir 220; however, the power source 250 can be configured in different shapes and disposed in various positions in the housing 215 or, in an alternative embodiment, on the wearable covering 210. The power source 250 may be a battery or other suitable device used to store energy. Further, the power source 250 may be attached in such a way that it is removable and replaceable. Any fastener known in the art including, but not limited to, elastic straps, hook-and-loop fasteners, and biasing members may be used to retain the power source 250 in the housing 215 or on the wearable covering 210.

Referring again to FIG. 5, the personal protection device 200 and its fluid delivery system 212 further comprise a force-sensing resistor (FSR) 265, which may also be called a force-sensitive resistor. As a force is applied across an appropriate portion of the surface of the FSR, the electrical resistance of the FSR 265 is reduced. The response of FSR 265, i.e. its variable resistance, can be measured by circuit board 285 to monitor and control the operation of personal protection device 200 based on that response. The FSR 265 will be said to be "activated" when a force equal to or greater than a predetermined or preset force-value is applied to the FSR 265, across an appropriate portion of the surface of the FSR. The predetermined force-value is established by circuit board 285, which recognizes when the resistance of the FSR 265 drops below a predetermined or preset resistance-value. The predetermined force-value and the predetermined resistance-value may also be called thresholds and, in some embodiments, may be adjusted by circuit board 285. A force equal to or greater the predetermined force-value may be called an activation force. In general, any FSR known in the art may be used including, but not limited to, an Interlink Electronics FSR® 400 series. In some embodiments, the FSR 265 is configured to be activated by a force ranging in between 0.05 and 2.2 pounds, applied across an appropriate portion of the surface of the force sensing resistor. The force applied to FSR 265 may be equated to a pressure and may be compared against a predetermined pressure-value. In some embodiments, the FSR 265 may be configured to be activated by a force less than 0.05 pounds or a force greater than 2.2 pounds while maintaining in a configuration appropriate for a device to be worn and used on a person's hand.

In an embodiment, the FSR 265 is disposed on and affixed to the thumb covering 216 between the wearer's second thumb knuckle (i.e. the knuckle closest to the tip of the thumb) and the base of the thumb nail. The FSR 265 is mounted on and affixed to the thumb covering 216 with any suitable fasteners known in the art including, but not limited to, elastic straps, hook-and-loop fasteners, adhesives, and thread or stitching. In an embodiment, the FSR 265 is mounted on or embedded in a material that, in turn, is affixed to the thumb covering 216. The material may be breathable fabric, synthetic, rubberized, plastic, or vinyl, as examples.

Figure 11:
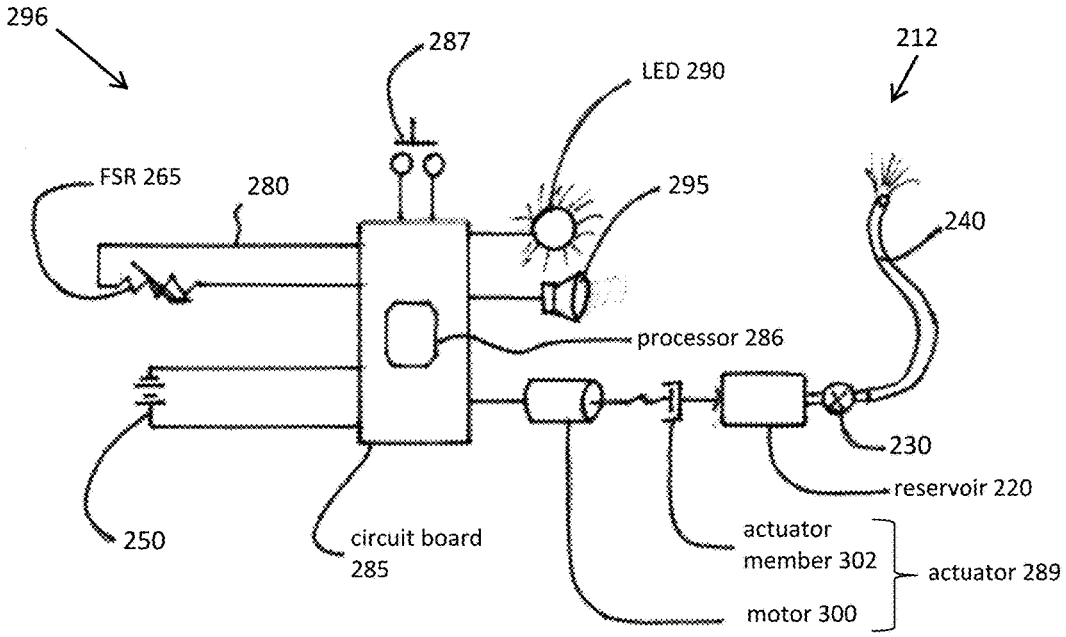
FIG. 11 is a schematic diagram of a portion of the embodiment shown in FIG. 5.

Referring now to FIG. 5 and FIG. 11, the personal protection device 200 further includes an electrical circuit 296 that comprises the circuit board 285 with a mounted processor 286, the power source 250, the switch 287, the FSR 265, the actuator 289, the light-emitting diode (LED) 290, the buzzer 295, and various electrical conductors. Various components of the circuit 296 are located in housing 215. The circuit 296 includes electrical conductors 280 that electrically couple the FSR 265 to the circuit board 285. The electrical conductors 280 are supported by and attached to the wearable covering 210. Additional electrical conductors couple the circuit board 285 to the power source 250, switch 287, actuator 289, light-emitting diode (LED) 290, and buzzer 295. In general, any suitable circuit board and suitable processor known in the art may be used. For simplicity while describing the present embodiment, the circuit board and mounted processor will be referred to collectively as circuit board 285. Push-button switch 287 can cause circuit board 285 to cycle between multiple operational modes, which may also be called states of operation, or simply "states." The operational modes will be described subsequently. In some other embodiments, switch 287 may be another suitable type of switch known in the art.

Figure 12:
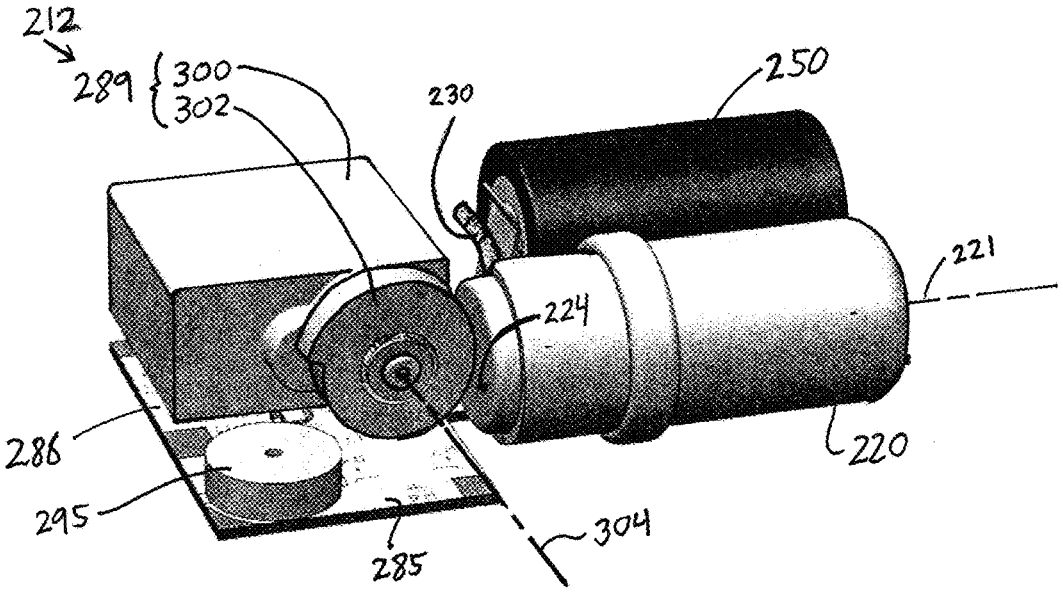
FIG. 12 is a perspective view of a portion of the embodiment shown in FIG. 5.

Referring now to FIG. 12, components of the fluid delivery system 212 are shown as positioned within housing 215. In the present embodiment, the actuator 289 includes a motor 300 powered by the power source 250 and an actuator member 302 coupled to the motor 300 for rotation about a motor axis 304, which is disposed perpendicular to axis 221 of reservoir 220 and may intersect reservoir axis 221. In the embodiment shown, the motor 300 is a servomotor, and actuator member 302 is an eccentric cam wheel, which will also be called a cam member 302. Other embodiments may use another suitable type of motor or another suitable type of actuator member. The cam member 302 is coupled to the reservoir 220 such that activating the motor 300 and rotating cam member 302 causes the reservoir 220 to move linearly relative to the valve 230 along reservoir axis 221 such that the valve 230 opens to release fluid from the reservoir. As an example, reservoir 220 may be mounted in housing 215 with freedom to move along axis 221 relative to housing 215, motor 300, and valve 230. In this configuration, cam member 302 may press directly or indirectly against a contact surface 224 coupled to reservoir 220 causing the reservoir to move while valve 230 is held in a fixed location relative to motor 300. In an example, contact surface 224 is on the bottom end of reservoir 220. As another example, valve 230 may be mounted in housing 215 with freedom to move along axis 221 relative to housing 215, motor 300, and reservoir 220. In this configuration, cam member 302 may press directly or indirectly against valve 230 while reservoir 220 is held in a fixed location relative to motor 300. Both arrangements are configured to move the reservoir 220 and the valve 230 closer together when actuator 289 is activated based on a signal from FSR 265. In either configuration, the actuator 289 is coupled to valve 230 and may also be called a valve actuator at least because it is configured to cause valve 230 to open and close. The actuator 289 may be any actuator known in the art, suitable for causing linear movement and suitably sized. In some other embodiments, cam member 302, reservoir 220, and valve 230 are configured and coupled such that rotation of cam member 302 causes valve 230 to move laterally relative to reservoir 220. This lateral motion may include, for example, linear motion of valve 230 or reservoir 220 perpendicular to reservoir axis 221 or pivotal motion of valve 230 or reservoir 220 away from reservoir axis 221.

Referring now to FIG. 8, FIG. 9, and FIG. 10, in the present embodiment, device 200 and circuit board 285 have three operational modes or states: (1) an "off" mode; (2) an "on" or "armed" mode; and (3) test mode. In the "off" mode, the personal protection device 200 is deactivated and non-functional, except the processor 286 is configured with the capability to detect contact made by switch 287 in order to "turn on" device 200 from the "off" modes. The device 200 may be activated to the "on" position or "armed" mode by pressing the switch 287 for a preset period of time and releasing switch 287, which may also cause buzzer 295 to emit a brief tone and LED 290 may blink briefly. Optionally, device 200 may be configured so that LED 290 continues to blink once every three to four seconds to indicate when it is in "armed" mode. When "armed," the device 200 is ready for the wearer to challenge an aggressor. The device 200 may be activated to the test mode by pressing switch 287 for a longer time period prior to releasing it or by pressing switch 287 two times in immediate sequence, depending on the wiring or programming of the circuit board 285. Buzzer 295 may emit two brief tones to indicate the activation of the test mode. Other sequences and durations for engaging switch 287 and other sequences and durations for the activation of a humanly observable first or second notification signal are contemplated.

When a force equal to or greater than the predetermined or preset activation force or pressure is applied to the FSR 265, FSR is said to be "activated." In at least one embodiment, when the personal protection device 200 is in the armed mode and FSR is activated, circuit board 285 will respond so that the LED 290 will light-up (i.e. illuminate; activate), the buzzer 295 will emit a beeping sound, and at least a portion of the pressurized fluid contained in the reservoir 220 will be released. The circuit board 285, switch 287, LED 290, and buzzer 295 may be configured in different ways. For example, in an embodiment, when the switch 287 is in the armed mode and the FSR 265 is activated, the LED 290 illuminates red and the buzzer 295 emits a rapid beeping sound; after the FSR 265 has been continuously activated for a preset period of time, the buzzer 295 switches from a rapid beeping to a constant beeping sound and the pressurized fluid is released from the reservoir 220.

In at least one embodiment, when the device 200 is in test mode and the predetermined activation force or pressure is applied to the FSR 265 to activate FSR 265, the LED 290 will illuminate and the buzzer 295 will emit a sequence of beeps; however, no pressurized fluid will be released from the reservoir 220 when the switch 287 is in test mode. Any conventional LED may be used, including LEDs configured to produce multiple colors. In the present embodiment, the LED 290 can display orange or red, selectively. In other embodiments, the LED 290 may be green, blue, orange, red, or any combination thereof. Further, any buzzer known in the art that makes an audible sound may be used. Other sequences of tones or lighting may be used for the armed mode and the test mode.

Further, in an embodiment, when the device 200 is in test mode and the FSR 265 is activated, the LED 290 illuminates orange and the buzzer 295 emits a rapid beeping sound; after the FSR 265 has been continuously activated for a predetermined or preset period of time, the buzzer 295 switches from a rapid beeping to a constant beeping sound. In the test mode, no pressurized fluid is released from the reservoir 220 regardless of how long the FSR 265 is activated. The test mode allows the wearer to practice using the personal protection device 200 without actually releasing any of the pressurized fluid.

To understand the operation of the personal protection device 200 in more detail, reference is now given to FIG. 6 and the circuit diagram of FIG. 11. When in the armed mode, the personal protection device 200 can be actuated by the wearer of the wearable covering 210 by forming the "got your nose" fist-like configuration shown in FIG. 6. To accomplish this, the wearer may close his/her the middle, ring, and small fingers into a fist, place the pad of the thumb adjacent the second knuckle of the middle finger and then place the index finger across the top of the thumb nail. Then the wearer may press or squeeze his/her the index and middle fingers against the top surface of the thumb between the knuckle and the base of the thumb nail, causing the inside, lower edge of the index finger to contact firmly the FSR 265 or the thumb covering 216 and exert a force against FSR 265. The force exerted on FSR 265 by the wearer's index finger may, of course, be equated to a pressure.

As the force of the index finger is exerted against FSR 265, the electrical resistance of the FSR 265 is reduced. When that applied force reaches a predetermined or preset level (i.e. equals or exceeds the "activation force"), the electrical resistance of the FSR 265 is reduced below a threshold value of resistance that is detected by the circuit board 285. The circuit board 285 and power source 250 then activate a humanly observable first notification signal and activate a delay period. The first notification signal may include, for example, illuminating the LED 290 in red or activating the buzzer 295 to emit a rapid beeping sound. This rapid beeping before spraying may alert the wearer of the device in the event the wearer has unintentionally applied a pressure to the FSR 265 so that the wearer can quickly remove the pressure from the FSR and avoid releasing and spraying any fluid. After the FSR 265 has been continuously activated for a preset length of time, i.e. the delay period has been completed, circuit board 285 activates a humanly observable second notification signal. For example, the buzzer 295 may switch from a rapid beeping to a constant beeping sound. In addition, the actuator 289 is activated by the circuit board 285 and the power source 250, and this action opens the valve 230 and releases the pressurized fluid (liquid or gas) from inside the reservoir 220, through the fluid delivery tube 240 and into the atmosphere via discharge end 243, causing the released fluid to be sprayed. The personal safety device 200 is configured to use the previously described hand configuration for actuation in order to reduce the possibility of accidental actuation and discharge of fluid from the device 200.

The wearer of the personal protection device 200 can aim a spray of fluid by simply pointing his/her thumb at a desired target before or while maintaining the proper hand configuration.

The wearer can stop the release of the pressurized fluid by lifting his/her index finger from the top of the thumb, thereby removing the force from FSR 265, which increases the resistance and stops the flow of energizing current to the circuit board 285. The circuit board 285 then removes power from the actuator 289 thereby closing the valve 230 and ceasing the release of the pressurized fluid. The wearer of the device 200 can continue to release fluid from the reservoir 220 by continuing to hold the index finger on top of the FSR 265, thereby maintaining the FSR's low resistance and thus maintaining the flow of current to the circuit board 285 to activate the actuator 289 and keep the valve 230 open. In some other embodiments, circuit board 285 includes a timer circuit or timer program module that allows only a prescribed duration or a prescribed amount of fluid flow to be released from reservoir 220 with each activation of FSR 265. To discharge more, the wear of device 200 would have to release FSR 265 and press it again. As previously discussed, in some embodiments, the reservoir 220 is removable and replaceable. Once all the fluid is dispelled from the reservoir 220, the reservoir may be removed and refilled or replaced with a new reservoir 220 pre-filled with the desired fluid.

The wearer of the wearable covering 210 can similarly activate the personal protection device 200 when the switch 289 is in test mode. The FSR 265 may again activated by applying a preset force or pressure as the wearer makes the "got your nose" fist-like configuration with his/her hand having the personal protection device 200 as shown in FIG. 6 and as described for the armed mode. The circuit board 285 and power source 250 then activate a humanly observable third notification signal and activate the delay period. The third notification signal may include, for example, illuminating LED 290 in orange or activating the buzzer 295 to emit a rapid beeping sound. After the FSR 265 has been continuously activated for the preset length of time, i.e. the delay period has been completed, circuit board 285 activates the humanly observable second notification signal or another notification signal. For example, the buzzer 295 may switch from a rapid beeping to a constant beeping sound; however, while in test mode, the actuator 289 is not activated and the valve 230 is not opened.

Figure 13:
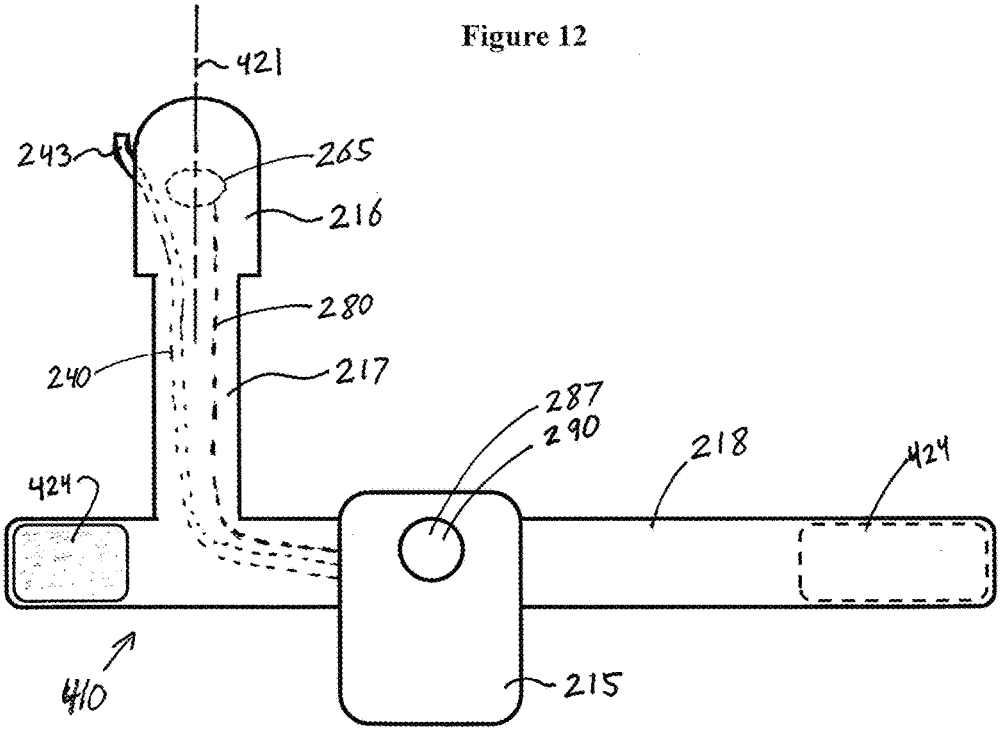
FIG. 13 is a top view of another right-handed embodiment of a personal protection device made in accordance with principles described herein.

FIG. 13 presents another example of a personal protection device (PPD). As shown, personal protection device 400 is configured for installation on the right hand of a wearer, but may also be configured for installation on a left hand. The personal protection device 400 includes a wearable covering 410, an enclosure or housing 215, a fluid delivery tube 240, and an electrical circuit 296, which includes a force-sensing resistor (FSR) 265. The housing 215, tube 240, electrical circuit 296, and FSR 265 are similar or identical to the identically named and numbered components described earlier and shown in FIG. 9, FIG. 10, FIG. 11, and various other figures. In this embodiment, switch 287 and LED 290 are install as a single unit and are readily accessible and visible.

The wearable covering 410 includes a thumb covering 416, a connecting or bridging portion 417, and a wrist strap 418. A covering axis 421 extends lengthwise through the middles of upper surfaces of covering 416 and portion 417. When worn on the body, the thumb covering 416 generally surrounds the tip of the wearer's thumb, the wearer's thumb nail, and at least a portion of the wearer's second knuckle on the thumb. The connecting portion 417 includes a straight portion that extends from the thumb covering 416 to the wrist strap 418 without wrapping around a portion of the wearer's palm. The connecting portion 417 is intended to lie along the back of the user's thumb and a narrow portion of the user's hand. The wrist strap 218 wraps around and covers a portion of the wearer's wrist and forearm and supports housing 215 on the back of the wrist, or, optionally, under the wrist. A two-part fastener 424 is attached to the ends the wrist strap 218. The wearable covering 410 is configured to cover less of the wear's hand and wrist than is covered by wearable coverings 10, 210 (FIG. 4, FIG. 5), potentially providing more comfort to the wearer or making personal protection device 400 less obvious to someone other than the wearer. The wearable covering 410 is configured to make the device less obtrusive or restrictive than a standard glove or wearable coverings 10, 210 so that the wearer of device 400 will retain as much dexterity as possible, i.e. can use his hand as normally as possible. In other respects, the construction and material of wearable covering 410 may be similar to that described for wearable covering 210.

The wearable covering 410 supports the fluid delivery tube 240 in much the same way as the wearable covering 210 of PPD 200 supports its fluid delivery tube 240. Again, an inlet end 242 of tube 240 is coupled to a valve 230 within housing 215. As shown in FIG. 13, the tube 240 extends within various portions of wearable covering 410 and terminates at a tubing discharge end 243 positioned on the outside of the thumb covering 416 proximate the tip of the thumb covering 416. The discharge end 243 is positioned alongside the location intended for the wear's thumb nail and is configured to direct a spray of fluid generally straightforward from the thumb, generally parallel to the covering axis 421. As examples, tube 240 may terminate adjacent the corner of the wearer's thumb nail or within +/−10 mm of the end of the wearer's thumb or thumb nail. The discharge end 243 is open to the atmosphere.

The characteristics of FSR 265 were previously described. In the personal protection device 400, the FSR 265 is located in the top portion of thumb covering 216 so as to be positioned between the wearer's second thumb knuckle and the base of the thumb nail; although, other locations for FSR 265 are possible. FSR 265 may be embedded within layers of thumb covering 216 or may be on a surface of the thumb covering 216. Electrical conductors 280 electrically couple FSR 265 to the circuit board 285 having a processor 286.

The personal protection device 400 operates like the personal protection device 200. Once activated to the armed mode (or state) or to the test mode (or state) by switch 287 the personal protection device 400 may be actuated by forming the "got your nose" fist-like configuration, which is shown in FIG. 6 for PPD 200. Depending on the mode of operation selected, PPD 400 may be actuated to open the valve 230 in order to spray a fluid, which may include producing a humanly observable notification signal (e.g. light, sound, or vibration). Or, PPD 400 may be actuated to perform a test that produces a humanly observable notification signal without opening the valve 230 and spraying a fluid.

The personal protection device 100, 200, 400 thus allows for the immediately available, handgun-like, aimed spraying of a repellant without limiting the normal use and function of the hand upon which the device 100, 200, 400 is worn. The inclusion of a force-sensing resistor may make the device less susceptible to accidental discharge of fluid. Further, because the device may be clearly visible during normal use even prior to actuating the spray, the device may act as a deterrent to would-be assailants. In some embodiments, the tubing 240, the housing 215, and other active components may be concealed so that an assailant will be less likely to recognize difference between the device 100, 200 and another hand covering, such as a typical glove, a partial glove, or a bandage. Because the activation force for the FSR 265 is adjustable and may be predetermined, at least the devices 200, 400 are personal protection devices that include adjustable activation.

Examples of various embodiments have been presented. Some possible variations or additional embodiments are described next. Additional embodiments may share compatible characteristics of one or more of the previously-described embodiments or those described below.

As discussed, FIG. 5 shows the tube 240 of PPD 200 extending along the top side of the wearer's thumb, and FIG. 13 shows the tube 240 of PPD 400 extending along the side of the wearer's thumb. Either location is possible for an embodiment similar to PPD 200 or PPD 400. In various other embodiments, wearable covering 210 covers more of the wear's hand, and in some of these embodiments the tube 240 extends along another part of the wear's hand and terminates, for example, having discharge end 243 located between two finger knuckles or in another advantageous location, pointing away from the wearer.

In some embodiments of a personal protection device 200, 400, switch 287 is a three-position switch rather than the push-button that was described, and the three positions correspond to the "off" mode; the "on" or "armed" mode, and the test mode of the device. In some embodiments, force-sensing resistor 265 is replaced by a simple, non-latching push button switch lacking the ability to sense the force applied to it. When a simple switch is used personal protection device 200, 400 will lack some functionality. For example, circuit board 285 will lack the ability to detect the force exerted by the wearer (user) and evaluate that force against a predetermined value. As examples, the simple button switch may include a common spring-loaded plastic button held in a rigid housing or a membrane switch, such those used in keypads for various calculators, microwaves, and control panels for equipment.

In some embodiments the valve that controls the flow of fluid to tubing 240 is configured to open and close by rotation relative to a fluid reservoir and further includes an actuator configure to cause the valve to rotate accordingly.

While exemplary embodiments have been shown and described, modifications thereof can be made by one of ordinary skill in the art without departing from the scope or teachings herein. The embodiments described herein are exemplary only and are not limiting. Many variations, combinations, and modifications of these embodiments or their various features are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A personal protection apparatus comprising:

a wearable covering;

a reservoir supported by the wearable covering;

a fluid delivery tube;

a valve fluidically coupled between reservoir and fluid delivery tube and operable to open and close and thereby to control the flow of fluid from the reservoir into the delivery tube;

a power source supported on the wearable covering;

an actuator coupled to the valve;

a force-sensing resistor supported on the wearable covering and configured to activate the actuator, wherein the force-sensing resistor is configured to provide a variable electrical resistance that decreases in response to the application of a force against the force-sensing resistor; and a circuit supported by the wearable covering and configured to actuate the valve when an external force applied to the force-sensing resistor is equal to or greater than a predetermined force for a length of time greater than zero;

wherein the apparatus is configured to release fluid from the reservoir when the valve is actuated; and wherein the circuit includes a processor that is configured to compare the external force applied to the force-sensing resistor to the predetermined force, and wherein the processor also is configured to govern the non-zero length of time that the external force equal to or greater than the predetermined force must be applied to the force-sensing resistor in order to release fluid from the reservoir.

2. The apparatus of claim 1, wherein the reservoir, valve, power source, and the actuator are disposed in a housing, the housing being coupled to the wearable covering.

3. The apparatus of claim 2, wherein the wearable covering includes a thumb covering, and wherein the force-sensing resistor is disposed on a portion of the thumb covering.

4. The apparatus of claim 1, further comprising a switch configured to control the release of the fluid from the reservoir and from a discharge end of the tube.

5. The apparatus of claim 4, wherein the apparatus is configured to have a first state in which the fluid is released when the force equal to or greater than the predetermined force-value is applied to the force-sensing resistor.

6. The apparatus of claim 5, wherein the apparatus is configured to have at least a second state in which no fluid is released when the force equal to or greater than the predetermined force-value is applied to the force-sensing resistor.

7. The apparatus of claim 6, wherein the apparatus is configured to activate a light emitting device or a sound emitting device when in the first or the second state and the force equal to or greater than the predetermined force-value is applied to the force-sensing resistor.

8. The apparatus of claim 3, wherein a portion of the fluid delivery tube is disposed along the thumb covering, and has a discharge end proximate the tip of the thumb covering.

9. The apparatus of claim 1 wherein the fluid is selected from the group consisting of an irritant, an inflammatory agent, and water.

10. A personal protection apparatus for a wearer, comprising:

a wearable covering comprising a thumb covering and a wrist strap, the thumb covering including a force-sensing resistor positioned to be activated when the wearer's thumb is positioned between the wearer's index finger and middle finger;

a reservoir supported by the wearable covering and configured for containing a fluid;

a fluid delivery tube supported at least in part by the thumb covering;

a valve configured to control the flow of fluid from the reservoir and through the fluid delivery tube;

a circuit supported by the wearable covering and configured to actuate the valve when an external force is applied to the force-sensing resistor; and an actuator coupled to the valve and electrically coupled to the circuit, and wherein the actuator comprises a cam member rotationally coupled to a motor;

wherein the circuit is configured to cause the actuator to open the valve when the external force is applied to the force-sensing resistor;

wherein the cam member is coupled to the reservoir to such that rotation of the cam member causes the reservoir to move relative to the valve such that the valve opens to release fluid from the reservoir.

11. The apparatus of claim 10, wherein the fluid delivery tube is disposed on the underside of the thumb covering.

12. The apparatus of claim 10, wherein the force-sensing resistor is disposed in the thumb covering between the locations intended for the wear's the knuckle and the thumb nail.

13. The apparatus of claim 10, wherein the apparatus is configured to release fluid from the reservoir when the external force applied to the force-sensing resistor is equal to or greater than a predetermined force-value.

14. The apparatus of claim 13, wherein the circuit includes a processor that is configured to govern or to adjust the predetermined force-value and is further configured to compare the predetermined force-value to the external force applied the force-sensing resistor;

wherein the processor also governs the length of time that the external force equal to or greater than a predetermined force-value must be applied to the force-sensing resistor in order to release fluid from the reservoir.

15. The apparatus of claim 10, wherein the circuit is configured to have a first activated state in which the valve is open to release fluid from the reservoir when the external force applied to the force-sensing resistor is equal to or greater than a predetermined force-value.

16. The apparatus of claim 15, wherein the circuit is configured to have at least a second activated state in which a humanly observable notification signal is produced but the valve is not open when the external force applied to the force-sensing resistor is equal to or greater than a predetermined force-value.

17. The apparatus of claim 10, wherein the circuit is configured to have a first state in which the circuit activates a humanly observable notification signal and activates a delay period when the external force applied to the force-sensing resistor is equal to or greater than a predetermined force-value;

wherein the circuit is further configured such that after the delay period is completed in the first state, the valve is open to release fluid from the reservoir when the external force applied to the force-sensing resistor is maintained equal to or greater than a predetermined force-value.

18. The apparatus of claim 10, wherein the reservoir and the valve are configured as an integral package;

wherein the valve is held in a generally fixed location relative to the motor; and wherein the reservoir is configured to move relative to the valve and the motor in order to open the valve.

* * * * *